US010343834B1

(12) United States Patent
Cosgrave et al.

(10) Patent No.: US 10,343,834 B1
(45) Date of Patent: Jul. 9, 2019

(54) FOIL COOKING BAG

(71) Applicants: Edward Cosgrave, Valdez, AK (US); Ryan Stock, Valdez, AK (US)

(72) Inventors: Edward Cosgrave, Valdez, AK (US); Ryan Stock, Valdez, AK (US)

( * ) Notice: Subject to any disclaimer, the term of this patent is extended or adjusted under 35 U.S.C. 154(b) by 17 days.

(21) Appl. No.: 15/584,566

(22) Filed: May 2, 2017

Related U.S. Application Data

(60) Provisional application No. 62/330,283, filed on May 2, 2016.

(51) Int. Cl.
*B65D 81/34* (2006.01)
*B65D 33/01* (2006.01)

(52) U.S. Cl.
CPC ..... *B65D 81/3407* (2013.01); *B65D 33/01* (2013.01)

(58) Field of Classification Search
CPC ..... B65D 81/3407; B65D 33/01
USPC ..... 383/100, 103, 9, 10, 88–92, 98, 99
See application file for complete search history.

(56) References Cited

U.S. PATENT DOCUMENTS 1,217,818 A 2/1917 Peterson
3,133,691 A 5/1964 Corbett
3,185,372 A 5/1965 Ferraro
3,322,319 A 5/1967 Sweeney
3,323,442 A 6/1967 Sandt
3,399,822 A * 9/1968 Kugler ..... B65D 33/01 383/103
3,528,600 A * 9/1970 White ..... B65D 33/01 383/100
3,730,076 A * 5/1973 Levin ..... A47J 36/022 99/347
3,750,873 A * 8/1973 Roman ..... B65D 75/30 206/389
4,057,949 A * 11/1977 Greffe ..... B65B 1/26 53/434
4,499,817 A 2/1985 Janssen
4,861,957 A * 8/1989 Welles ..... B65D 31/02 219/730
4,866,786 A * 9/1989 Nagler ..... B65D 31/04 383/101
5,114,243 A * 5/1992 Thier ..... B65D 33/24 383/85
5,227,599 A * 7/1993 Mason ..... B65D 81/3461 219/730
7,001,628 B1 * 2/2006 Unwin ..... A47J 37/0871 426/234
2007/0134378 A1 6/2007 Burton
2008/0087268 A1 * 4/2008 Burton ..... B65D 33/1641 126/9 R

FOREIGN PATENT DOCUMENTS

JP 11113617 A * 4/1999

OTHER PUBLICATIONS

Machine Translation of the description of JP-11113617-A.*

* cited by examiner

*Primary Examiner* — Jes F Pascua
(74) *Attorney, Agent, or Firm* — Cramer Patent & Design, PLLC; Aaron R. Cramer

(57) ABSTRACT

A cooking bag includes an open end with a pair of fan folded edges. Within the fan folded edges are a plurality of apertures which are both aligned and in environmental communication with the interior of the bag when folded closed.

10 Claims, 2 Drawing Sheets

FOIL COOKING BAG

RELATED APPLICATIONS

The present invention was first described in and claims the benefit of U.S. Provisional Application No. 62/330,283, filed May 2, 2016, the entire disclosures of which are incorporated herein by reference.

FIELD OF THE INVENTION

The present invention relates generally to the field of outdoor cooking supplies and more specifically relates to a foil bag system.

BACKGROUND OF THE INVENTION

Outdoor cooking differs substantially from kitchen-based cooking, the most obvious difference being lack of an easily defined kitchen area. As a result, campers and backpackers have developed a significant body of techniques and specialized equipment for preparing food in outdoors environments.

The most traditional method for outdoor cooking is by means of a campfire or grilling. Campfires may be used for cooking food by a number of techniques. The techniques for cooking on a campfire are no different from those used for everyday cooking before the invention of stoves or where stoves are still not available. Individuals who are backpacking in an area which allows the gathering of firewood may decide to cook on a campfire to avoid the need to carry extra equipment. Cooking food using a campfire may be tricky without proper tools and equipment. Therefore, a suitable solution is desired.

Various attempts have been made to solve problems found in outdoor cooking supplies art. Among these are found in: U.S. Pat. Nos. 8,431,203; 3,323,442; and 3,750,873. These prior art references are representative of outdoor cooking supplies.

None of the above inventions and patents, taken either singly or in combination, is seen to describe the invention as claimed. Thus, a need exists for a reliable foil bag system, and to avoid the above-mentioned problems.

SUMMARY OF THE INVENTION

The inventor has recognized the aforementioned issues and inherent problems and observed that there is a lack in the prior art for a foil bag system.

It is therefore an object of the invention to provide a cooking device, comprising an enclosure defining an interior comprising an opening, a first side, a second side, a third side, a fourth side and a fifth side, a first side folded section above the opening and superjacent the first side, a plurality of first side folded section apertures disposed within the first side folded section, a second side folded section above the opening and superjacent the second side, and a plurality of second side folded section apertures disposed within the second side folded section. In a separate embodiment, the enclosure may define an interior comprising an opening, a first side, a second side having an identical shape to and disposed parallel to the first side, a third side, a fourth side having an identical shape to and disposed to the third side and a fifth side disposed parallel to the opening.

The plurality of the first side folded section apertures and the plurality of second side folded section apertures are capable of being aligned to provide fluid communication with the interior of the enclosure.

The first side folded section may also comprise a first side folded section first fold having a plurality of first fold apertures, a first side folded section second fold having a plurality of second fold apertures and a first side folded section third fold having a plurality of third fold apertures.

The second side folded section may also comprise a second side folded section first fold having a plurality of first fold apertures, a second side folded section second fold having a plurality of second fold apertures and a second side folded section third fold having a plurality of third fold apertures.

The plurality of first fold apertures, second fold apertures and third fold apertures may comprise at least six (6) apertures. The enclosure may comprise aluminum foil.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
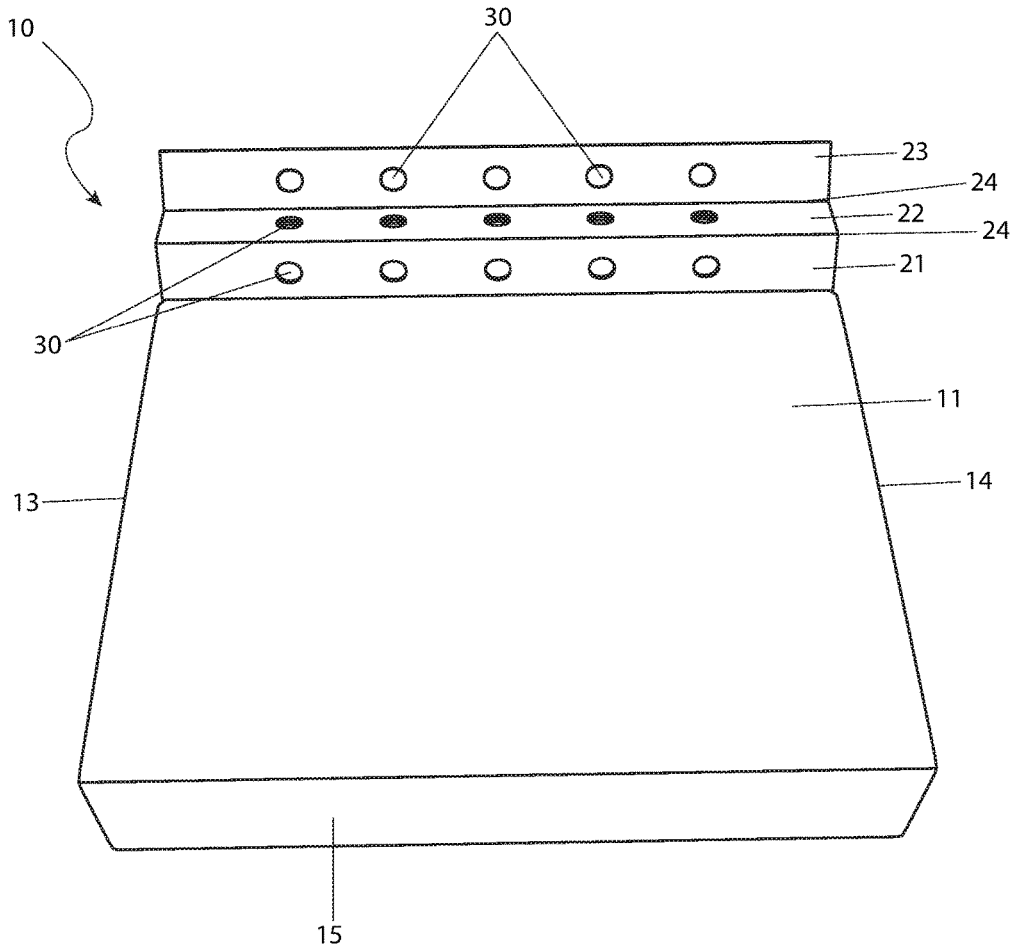
FIG. 1 is a top view of a foil cooking bag 10, according to an embodiment of the present invention.

10 foil cooking bag
11 first side
12 second side
13 third side
14 fourth side
15 bottom side
20 open end
21 first folded section
22 second folded section
23 third folded section
24 fold seam
30 aperture

DETAILED DESCRIPTION OF THE PREFERRED EMBODIMENT

The present invention is directed to a foil cooking bag 10. In one (1) embodiment of the present invention, the foil cooking bag 10 may comprise a three-fold closing mechanism having apertures 25 for steam release.

Referring now to the drawings, there is shown in FIG. 1 a foil cooking bag 10 comprising a five-sided enclosure with an open end 20. Opposite the open end 20 is a bottom side 15. A first side 11 and second side 12 are parallel to each other. A third side 13 and fourth side 14, smaller in width than the first side 11 and second side 12, are also parallel to each other. The foil cooking bag 10 is a metal foil bag, preferably made of aluminum foil. A pair of three-fold closing mechanisms is located at an end of both the first side 11 and second side 12 adjacent the open end 20. Each mechanism comprises a first folded section 21 affixed via a fold seam 24 to the respective first side 11 or second side 12, both capable of bending towards a common direction. A second folded section 22, each bending towards a common direction opposite that of the first folded section 21, is affixed to the first folded section 21 via a fold seam 24. A third folded section 23, each bending towards a common direction opposite that of the second folded section 22, is affixed to the second folded section 23 via another fold seam 24. Each of the folded sections 21, 22, 23 may comprise a plurality of apertures 30 designed to be positioned such that each aperture 30, aligns with each other and is in fluid communication with the interior of the foil cooking bag 10 when the pair of three-fold closing mechanisms are folded together. This provides a vent for steam produced during cooking of food placed within the foil cooking bag 10. In a closed position, the apertures 30 will align, such that when under pressure, steam may release through the apertures 30 of the pairs of three-fold closing mechanisms. The three-fold closing mechanisms may further allow users to open and fill the foil cooking bag 10 with comestible items, or alternatively, empty the foil cooking bag 10.

Figure 2:
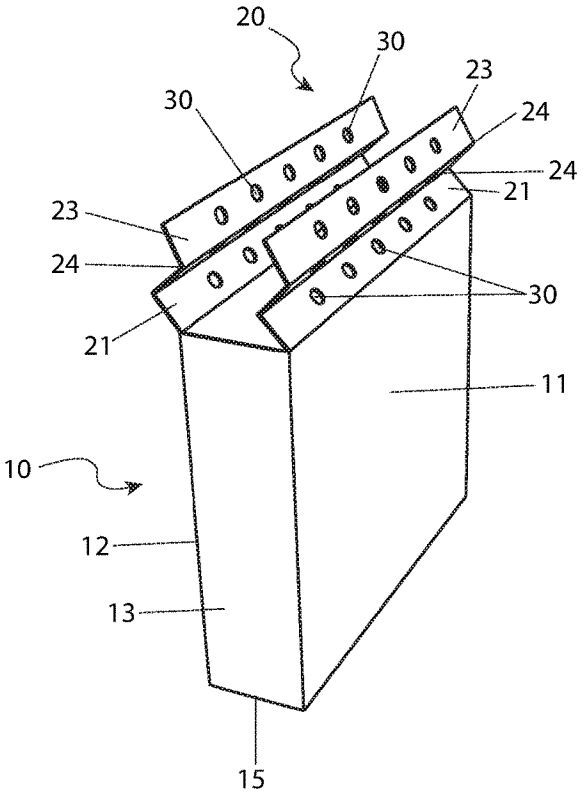
FIG. 2 is a side view illustrating the foil cooking bag 10 in an open condition comprising a folded end portion having holes for ventilation according to an embodiment of the present invention; and, FIG. 3 is a rear perspective view illustrating the foil bag system in a closed condition comprising the folded end portion according to an embodiment of the present invention.

Referring now to FIG. 2 showing a perspective view of foil cooking bag 10. In order to provide for ready access to the contents of the foil cooking bag 10, the three-fold closing mechanisms are adapted to be closed by means that may be readily released so that the foil cooking bag 10 may be filled or emptied through the open end 20. The foil cooking bag 10 may be manufactured in various sizes and shapes to accommodate cooking a variety of comestible items. In one (1) embodiment, the foil cooking bag 10 is approximately eighteen inches (18 in.) long and six inches (6 in.) wide to allow users to cook a whole fish fillet. In another embodiment, the foil cooking bag 10 may comprise a length of eleven inches (11 in.) and a width of eight-and-a-half inches (8½ in.). Further, the foil cooking bag 10 may comprise a length of eight inches (8 in.) and a width of eight-and-a-half inches (8½ in.).

Figure 3:
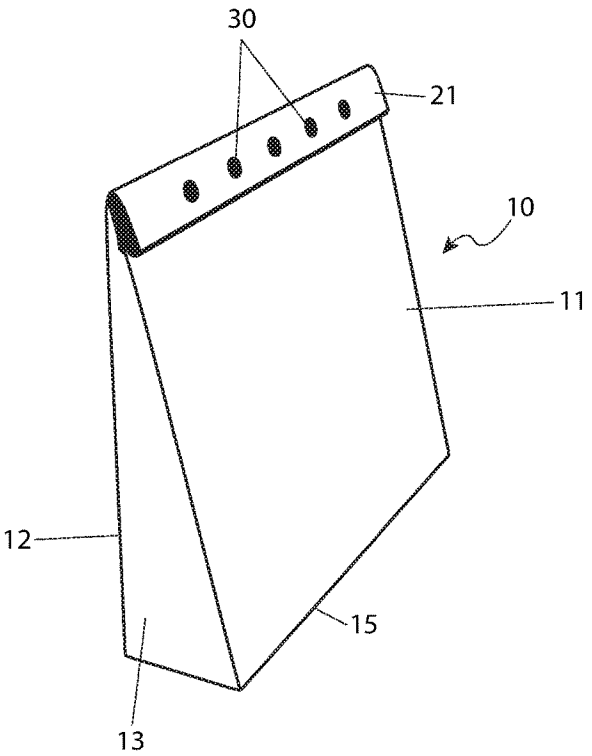

Referring now to FIG. 3 showing the foil cooking bag 10 in a closed condition. The foil cooking bag 10 may comprise an aluminum foil body to allow the foil cooking bag 10 to be placed directly on a grill or open flame. Aluminum foil provides as a conductor and radiator of heat. Further, aluminum foil is resistant to high temperatures. During the cooking process, fats and juices from the comestible item will be enveloped within the foil cooking bag 10 which, in turn, continuously bastes the comestible item during the cooking process. The foil cooking bag 10 therefore maintains a self-basting process and retains heat in order to reduce cooking time. The foil cooking bag 10 keep natural juices locked in, therefore, a more tender and tasteful product is produced. The exact specifications, materials used, and method of use of the foil cooking bag 10 may vary upon manufacturing.

The exact specifications, materials used, and method of use of the foil cooking bag 10 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A cooking device, comprising:

an enclosure defining an interior comprising:
- an opening;
- a first side;
- a second side;
- a third side;
- a fourth side; and,
- a fifth side;

a first side folded section above said opening and superjacent said first side;

a plurality of first side folded section apertures disposed within said first side folded section;

a second side folded section above said opening and superjacent said second side;

a plurality of second side folded section apertures disposed within said second side folded section;

wherein, said plurality of said first side folded section apertures and said plurality of second side folded section apertures are capable of being aligned to provide fluid communication with said interior of said enclosure; and, wherein said first side folded section comprises:
- a first side folded section first fold having a plurality of first fold apertures;
- a first side folded section second fold having a plurality of second fold apertures; and,
- a first side folded section third fold having a plurality of third fold apertures; and wherein said plurality of first fold apertures comprises at least six apertures;

wherein said plurality of second fold apertures comprises at least six apertures; and, wherein said plurality of third fold apertures comprises at least six apertures.

2. The device of claim 1, wherein said second side folded section comprises:
- a second side folded section first fold having a plurality of first fold apertures;
- a second side folded section second fold having a plurality of second fold apertures; and,
- a second side folded section third fold having a plurality of third fold apertures.

3. The device of claim 2, wherein said plurality of first fold apertures comprises at least six apertures.

4. The device of claim 2, wherein said plurality of second fold apertures comprises at least six apertures.

5. The device of claim 2, wherein said plurality of third fold apertures comprises at least six apertures.

6. A cooking device, comprising:

an enclosure defining an interior comprising:
- an opening;
- a first side;
- a second side having an identical shape to and disposed parallel to said first side;
- a third side;
- a fourth side having an identical shape to and disposed to said third side; and,
- a fifth side disposed parallel to said opening;

a first side folded section above said opening and superjacent said first side;

a plurality of first side folded section apertures disposed within said first side folded section;

a second side folded section above said opening and superjacent said second side;

a plurality of second side folded section apertures disposed within said second side folded section;

wherein, said plurality of said first side folded section apertures and said plurality of second side folded section apertures are capable of being aligned to provide fluid communication with said interior of said enclosure; and, wherein said first side folded section comprises:

a first side folded section first fold having a plurality of first fold apertures;

a first side folded section second fold having a plurality of second fold apertures; and, a first side folded section third fold having a plurality of third fold apertures; and wherein said plurality of first fold apertures comprises at least six apertures;

wherein said plurality of second fold apertures comprises at least six apertures; and, wherein said plurality of third fold apertures comprises at least six apertures.

7. The device of claim 6, wherein said second side folded section comprises:

a second side folded section first fold having a plurality of first fold apertures;

a second side folded section second fold having a plurality of second fold apertures; and, a second side folded section third fold having a plurality of third fold apertures.

8. The device of claim 7, wherein said plurality of first fold apertures comprises at least six apertures.

9. The device of claim 7, wherein said plurality of second fold apertures comprises at least six apertures.

10. The device of claim 7, wherein said plurality of third fold apertures comprises at least six apertures.

* * * * *